US007902130B2

(12) United States Patent
Baumanis et al.

(10) Patent No.: US 7,902,130 B2
(45) Date of Patent: Mar. 8, 2011

(54) MULTIFUNCTIONAL DISPERSANTS

(75) Inventors: Charles K. Baumanis, Geneva, OH (US); Mark R. Baker, Lyndhurst, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 604 days.

(21) Appl. No.: 11/816,215

(22) PCT Filed: Feb. 8, 2006

(86) PCT No.: PCT/US2006/004576

§ 371 (c)(1),
(2), (4) Date: May 12, 2008

(87) PCT Pub. No.: WO2006/091387

PCT Pub. Date: Aug. 31, 2006

(65) Prior Publication Data

US 2009/0054278 A1 Feb. 26, 2009

Related U.S. Application Data

(60) Provisional application No. 60/654,164, filed on Feb. 18, 2005.

(51) Int. Cl.
*C10M 163/00* (2006.01)
*C10M 139/00* (2006.01)
*C10L 1/22* (2006.01)

(52) U.S. Cl. ..... 508/185; 508/192; 508/196

(58) Field of Classification Search ..... 508/185, 508/192, 196
See application file for complete search history.

(56) References Cited

U.S. PATENT DOCUMENTS

| | | | | |
|---|---|---|---|---|
| 3,172,892 | A | 3/1965 | Le Suer et al. | 260/326.5 |
| 3,287,271 | A | 11/1966 | Stuart et al. | 252/49.9 |
| 3,374,174 | A | 3/1968 | Le Suer | 252/51.5 |
| 3,381,022 | A | 4/1968 | Le Suer | 260/404.8 |
| 3,411,369 | A | 11/1968 | Hammann et al. | 74/200 |
| 3,708,522 | A * | 1/1973 | LeSuer | 560/198 |
| 4,136,043 | A * | 1/1979 | Davis | 508/231 |
| 4,234,435 | A | 11/1980 | Meinhardt et al. | 252/51.5 |
| 4,704,490 | A | 11/1987 | Tsubouchi et al. | 585/1 |
| 4,724,091 | A | 2/1988 | Davis | 252/33.4 |
| 4,857,214 | A | 8/1989 | Papay et al. | |
| 5,164,103 | A | 11/1992 | Papay | 252/49.9 |
| 5,330,667 | A | 7/1994 | Tiffany et al. | |
| 5,344,579 | A | 9/1994 | Ohtani et al. | 252/51.5 R |
| 5,407,453 | A | 4/1995 | Pierce Ruhland et al. | 44/411 |
| 5,697,988 | A | 12/1997 | Malfer et al. | 44/415 |
| 6,103,673 | A | 8/2000 | Sumiejski et al. | 508/186 |
| 6,251,840 | B1 | 6/2001 | Ward, Jr. et al. | 508/162 |
| 6,348,075 | B1 | 2/2002 | Jackson | 44/432 |
| 6,451,745 | B1 | 9/2002 | Ward | |
| 6,458,172 | B1 | 10/2002 | Macduff et al. | 44/348 |
| 6,528,458 | B1 | 3/2003 | Tagliamonte et al. | |
| 7,429,554 | B2 | 9/2008 | Waters et al. | |
| 2003/0224948 | A1 | 12/2003 | Dam et al. | 508/192 |
| 2005/0041395 | A1 | 2/2005 | Tipton et al. | |
| 2008/0248980 | A1 | 10/2008 | Sumiejski | |

FOREIGN PATENT DOCUMENTS

| | | |
|---|---|---|
| EP | 1077249 | 2/2001 |
| WO | WO 2006/045044 | 4/2006 |

OTHER PUBLICATIONS

Corresponding PCT Publication WO 2006/091387 A2 and Search Report; date of publication of Search Report: Aug. 31, 2006.
USPTO Office Communicaton mailed Sep. 2, 2010 for copending U.S. Appl. No. 11/816,206.

* cited by examiner

*Primary Examiner* — Walter D Griffin
*Assistant Examiner* — Frank C Campanell
(74) *Attorney, Agent, or Firm* — David M. Shold; Christopher D. Hilker

(57) ABSTRACT

The present invention provides a composition comprising the product prepared by hearing together: (a) a dispersant; and (b) a 1,3-dicarboxylic acid or 1,4-dicarboxylic acid of an aromatic compound, or a reactive equivalent thereof; and at least one of: (c) 2,5-dimercapto-1,3,4-thiadiazole or a hydrocarbyl-substituted 2,5-dimercapto-1,3,4-thiadiazole, or an oligomer thereof; (d) a borating agent; and (e) a phosphorus acid compound, or a reactive equivalent thereof, said heating being sufficient to provide a reaction product of (a), (b), and (c), (d), or (e), which is soluble in an oil of lubricating viscosity. The invention further provides a use for the composition.

25 Claims, No Drawings

MULTIFUNCTIONAL DISPERSANTS

BACKGROUND OF THE INVENTION

The present invention relates to a lubricant additive formulation containing a multifunctional dispersant and its use in a lubricating composition, for example in automatic transmission fluids.

Automatic transmission fluids (ATFs) present highly challenging technological problems and solutions for satisfying the multiple and often conflicting lubricating and power transmitting requirements of modern automatic transmissions (including continuously variable transmissions of various types). Many additive components are typically included in an ATF, providing such performance characteristics as lubrication, dispersancy, friction control (for clutches), anti-wear performance, and anti-corrosion and anti-oxidation performance. Finding and providing the correctly balanced composition is a significant formulating challenge.

Examples of formulations that have been employed in the past include those represented by U.S. Pat. No. 5,164,103, Papay, Nov. 17, 1992, which discloses preconditioned ATFs made by using a preblend formed by heating an alkenyl succinimide or succinimide detergent with a phosphorus ester and water to partially hydrolyze the ester, and then mixing the preblend and other additives with a base oil. Boronating agents may also be used. Thiadiazole derivatives may be included as another additive.

U.S. Pat. No. 5,344,579, Ohtani et al, Sep. 6, 1994, discloses a friction modifier composition which may be used in a wet clutch or wet brake system. The composition comprises a hydroxyalkyl aliphatic imidazoline and a di(hydroxyalkyl) aliphatic tertiary amine. The compositions may also contain a phosphorus-containing ashless dispersant and/or a boron-containing ashless dispersant. Among other components are copper corrosion inhibitors such as 2,5-dimercapto-3,4,-thiadiazole.

U.S. Pat. No. 6,251,840, Ward, Jr. et al., Jun. 26, 2001, discloses an automatic transmission fluid comprising a majority of an oil having a certain viscosity, 0.025-5 weight percent 2,5-dimercapto-1,3,4-thiadiazole (DMTD) or one or more derivatives of DMTD, an antifoam agent, and 0.01-0.3 weight percent of 85% phosphoric acid. Derivatives of DMTD include products from combining an oil soluble dispersant with DMTD. These may be obtained by mixing a thiadiazole, preferably DMTD with an oil-soluble carboxylic dispersant in a diluent by heating the mixture above about 100° C.

In another area (internal combustion engine lubrication), U.S. Pat. No. 4,136,043, Davis, Jan. 23, 1979, discloses compositions which form homogeneous blends with lubricating oils and the like, produced by preparing a mixture of an oil-soluble dispersant and a dimercaptothiadiazole and heating the mixture above about 100° C. The compositions are useful for suppression of copper activity and "lead paint" deposition in lubricants.

US Patent Application 2003/0224948, Van Dam et al., published Dec. 4, 2003, discloses an additive formulation containing ethylene carbonate polyalkene succinimides, borated dispersants and dispersed aromatic dicarboxylic acid corrosion inhibitors that are succinimide salts of one or more aromatic dicarboxylic acids. Furthermore, U.S. Pat. Nos. 3,287,271; 3,374,174; and 3,692,681 disclose methods of making dispersed aromatic dicarboxylic acid corrosion inhibitors that are succinimide salts of one or more aromatic dicarboxylic acids.

The present invention solves the problem of providing a lubricant additive, especially for an ATF, which provides multiple aspects of the required functionality to the lubricant, by way of supplying a multifunctional dispersant, thus reducing the complexity and variability, and potentially also the treat rate and cost, of the formulation.

SUMMARY OF THE INVENTION

The present invention provides a composition comprising the product prepared by heating together: (a) a dispersant; and (b) a 1,3-dicarboxylic acid or 1,4-dicarboxylic acid of an aromatic compound, or a reactive equivalent thereof; and at least one of: (c) 2,5-dimercapto-1,3,4-thiadiazole or a hydrocarbyl-substituted 2,5-dimercapto-1,3,4-thiadiazole, or an oligomer thereof; (d) a borating agent; and (e) a phosphorus acid compound, or a reactive equivalent thereof, said heating being sufficient to provide a reaction product of (a), (b), and (c), (d), or (e) which is soluble in an oil of lubricating viscosity.

The invention further provides a composition comprising an oil of lubricating viscosity and the composition described above, as well as a method for lubricating a mechanical device such as a transmission, comprising supplying thereto said lubricant composition.

DETAILED DESCRIPTION OF THE INVENTION

The present invention provides a composition comprising the product prepared by heating together: (a) a dispersant; and (b) a 1,3-dicarboxylic acid or 1,4-dicarboxylic acid of an aromatic compound, or a reactive equivalent thereof; and at least one of: (c) 2,5-dimercapto-1,3,4-thiadiazole, or an oligomer thereof or a hydrocarbyl-substituted 2,5-dimercapto-1,3,4-thiadiazole, or an oligomer thereof; (d) a borating agent; and (e) a phosphorus acid compound, or a reactive equivalent thereof, said heating being sufficient to provide a reaction product of (a), (b), and (c), (d), or (e) which is soluble in an oil of lubricating viscosity.

The Dispersant

The present invention comprises a dispersant. The dispersant of the invention is well known and includes succinimide dispersants, Mannich dispersants, ester-containing dispersants, condensation products of fatty hydrocarbyl monocarboxylic acylating agents with an amine or ammonia, alkyl amino phenol dispersants, hydrocarbyl-amine dispersants, polyether dispersants, polyetheramine dispersants, and viscosity modifiers containing dispersant functionality.

Succinimide dispersants are N-substituted long chain alkenyl succinimides, having a variety of chemical structures including typically:

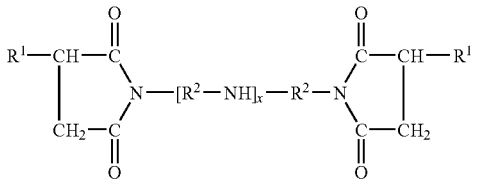

wherein each $R^1$ is independently a hydrocarbyl or alkyl group (which may be substituted by more than one succinimide group), frequently a polyisobutyl group with a molecular weight of 500-5000;

$R^2$ are alkylene groups, commonly ethylene ($C_2H_4$) groups; and x is an integer from 1 to 15 or 1 to 8.

Such molecules are commonly derived from reaction of an alkenyl acylating agent with an amine, including monoamines, polyamines (illustrated in the formula above), and hydroxyamines, and a wide variety of linkages between the two moieties is possible besides the simple imide structure shown above, including a variety of amides and quaternary ammonium salts.

The $R^1$ group in the above structure generally contains an average of at least 8, or 30, or 35 up to 350, or to 200, or to 100 carbon atoms. In one embodiment, the hydrocarbyl group is derived from a polyalkene characterised by an $\overline{M}_n$ (number average molecular weight) of at least 500. Generally, the polyalkene is characterised by an $\overline{M}_n$ of 500, or 700, or 800, or even 900 up to 5000, or to 2500, or to 2000, or even to 1500 or 1200. Polyolefins which may form the hydrocarbyl substituent may be prepared by polymerising olefin monomers by well known polymerisation methods, as described above, and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers may also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene may have a vinylidene double bond content of 5 to 69%, in a second instance of 50 to 69%, and in a third instance of 50 to 95% of the polyisobutylene molecules. The polyolefin may be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The types of amines which may be used include monoamines, polyamines, alkanolamines, thiol-containing amines, and mixtures thereof. In order to be suitably reactive, the amine should contain at least one primary or secondary amine nitrogen atom, unless another reactive moiety, such as an OH group, is also present. The condensation product may be amide or imide, in the case of a monoamine or polyamine or an amide and/or ester and/or heterocyclic reaction product in the case of an alkanolamine.

The amine may be a monoamine having one amine group and includes primary and secondary monoamines such as methylamine and dimethylamine. The monoamine may have 1 to 30 carbon atoms or 2 to 18 or 3 to 12 carbon atoms. Alternatively, the amine may be a polyamine having two or more amine groups where a first amine group is a primary amine group and a second amine group is a primary or secondary amine group. The reaction product of the monocarboxylic acylating agent and the polyamine may contain, in greater or lesser amounts depending on reaction conditions, a heterocyclic reaction product such as 2-imidazoline reaction products. The polyamine may have 2 to 30 carbon atoms. The polyamine may include alkylenediamines, N-alkyl alkylenediamines, and polyalkylenepolyamines. Useful polyamines include ethylenediamine, 1,2-diaminopropane, N-methylethylenediamine, N-tallow($C_{16}$-$C_{18}$)-1,3-propylenediamine, N-oleyl-1,3-propylenediamine, polyethylenepolyamines such as diethylenetriamine and triethylenetetramine and tetraethylenepentamine and polyethylenepolyamine bottoms.

The amine may also be an alkanolamine having at least one amine group and at least one hydroxyl group, where the amine group is a primary, secondary or tertiary amine group. The alkanolamine may have 2 to 30 carbon atoms. The alkanolamine may include mono-, di- and tri-alkoxylates of ammonia such as mono- and di- and tri-ethanolamine, hydroxy-containing monoamines such as a diethoxylated $C_{16}$ to $C_{18}$ tallowamine, and hydroxy-containing polyamines such as 2-(2-aminoethylamino)ethanol.

Succinimide dispersants and their methods of preparation are more fully described in U.S. Pat. Nos. 4,234,435 and 3,172,892.

Another class of dispersant is ester-containing dispersants, which are typically high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are de-scribed in more detail in U.S. Pat. No. 3,381,022. Similarly, dispersants may be prepared by condensation of a hydrocarbyl acylating agent with both an amine and an alcohol, each as described above.

Mannich dispersants are the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, 1-hexadecene which are commercially available. The polyolefins which may form the hydrocarbyl substituent may be prepared by polymerising olefin monomers by well known polymerisation methods, and include the polyolefins described above. The hydrocarbyl-substituted phenol may be prepared by alkylating phenol with an olefin or polyolefin described above, such as a polyisobutylene or polypropylene, using well-known alkylation methods.

The aldehyde used to form the Mannich dispersant may have 1 to 10 carbon atoms, and is generally formaldehyde or a reactive equivalent thereof such as formalin or paraformaldehyde.

The amine used to form the Mannich dispersant may be a monoamine or a polyamine, including alkanolamines, having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethylamino)ethanol. The Mannich dispersant may be prepared by reacting a hydrocarbyl-substituted phenol, an aldehyde, and an amine as described in U.S. Pat. No. 5,697,988. In an embodiment of this invention the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The dispersant may also be a condensation product of a fatty hydrocarbyl monocarboxylic acylating agent, such as a fatty acid, with an amine or ammonia. The hydrocarbyl portion of the fatty hydrocarbyl monocarboxylic acylating agent may be an aliphatic group. The aliphatic group may be linear, branched, or a mixture thereof. The aliphatic group may be saturated, unsaturated, or a mixture thereof. The aliphatic group may have 1 to 50 carbon atoms, in another instance 2 to 30 carbon atoms, and in a further instance 4 to 22 carbon atoms, such as 8, 10, or 12 to 20 carbon atoms. If the fatty hydrocarbyl monocarboxylic acylating agent is an aliphatic carboxylic acid, it may be seen as comprising a carboxy group (—COOH) and an aliphatic group. Thus, the total number of carbon atoms in the carboxylic acid may be 2 to 52, or 3 to 30, or 5 to 23, or 9, 11, or 13 to 21. The monocarboxylic acylating agent may be a monocarboxylic acid or a reactive equivalent thereof, such as an anhydride, an ester, or an acid halide such as stearoyl chloride. Useful monocarboxylic acylating agents are available commercially from numerous suppliers and include tall oil fatty acids, oleic acid, stearic acid and isostearic acid. Fatty acids containing 12 to 24 carbon atoms, including C18 acids, are particularly useful. In one embodiment the hydrocarbyl monocarboxylic acylating agent comprises a polyisobutylene based monocarboxylic acid, such as the reaction product of polyisobutylene and acrylic acid. The amine may be any of the amines described above.

In one embodiment of this condensation product dispersant, the amine is a polyamine. In another embodiment of the invention the monocarboxylic acylating agent and the polyamine are respectively a $C_4$ to $C_{22}$ fatty carboxylic acid and an alkylenediamine or a polyalkylenepolyamine, and in a further embodiment the fatty carboxylic acid is isostearic acid and the polyamine is a polyethylenepolyamine such as tetraethylenepentamine.

The monocarboxylic acylating agents and amines are commercially available. Their condensation products may generally be prepared by forming a mixture thereof at ambient to elevated temperatures of 50 to 200° C., and heating the mixture at elevated temperatures of 100 to 300° C. until the reaction product is formed in a satisfactory amount, as is more completely described in the reaction procedures in columns 37 and 39 of U.S. Pat. No. 4,724,091.

Alkyl amino phenol dispersants are hydrocarbyl-substituted aminophenols. The hydrocarbyl substituent of the aminophenol may have 10 to 400 carbon atoms, in another instance 30 to 180 carbon atoms, and in a further instance 10 or 40 to 110 carbon atoms. The hydrocarbyl substituent may be derived from an olefin or a polyolefin, as described above in connection with the Mannich dispersant. The hydrocarbyl-substituted aminophenol may have one or more hydrocarbyl substituents but generally has a single hydrocarbyl substituent. The hydrocarbyl-substituted aminophenol may have one or more amino groups, in another instance may have two amino groups, and in a further instance may have a single amino group. The amino group of the aminophenol may be represented by the formula —$NH_2$. The hydrocarbyl-substituted aminophenol may be prepared by alkylating phenol with an olefin or a polyolefin, nitrating the alkylated phenol with a nitrating agent such as nitric acid, and reducing the nitrated phenol with a reducing agent such as hydrazine at temperatures of 100 to 200° C. or with a metal catalyzed hydrogenation as described in U.S. Pat. No. 4,724,091.

Hydrocarbyl-amine dispersants are hydrocarbyl-substituted amines. The hydrocarbyl substituent of the amine may be the same as described above. In an embodiment of the invention the hydrocarbyl substituent of the hydrocarbyl-amine dispersant is a polyisobutylene having a number average molecular weight of 140 to 5600, in a second instance of 420 to 2500, and in a third instance of 140 or 560 to 1540. The amine of component, which is substituted by the hydrocarbyl group, may be derived from ammonia, a monoamine, or a polyamine or alkanolamine as described above. Useful amines include ethylamine, dimethylamine, ethanolamine, ethylenediamine, 2-(2-aminoethylamino)ethanol, and polyethylenepolyamines such as diethylenetriamine. The hydrocarbyl-substituted amine may be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines may be represented by the formula $R[OCH_2CH(R^4)]_nA$, where R is a hydrocarbyl group, $R^4$ is hydrogen or a hydrocarbyl group of 1 to 16 carbon atoms, or mixtures thereof, n is 2 to 50, and A may be —$OCH_2CH_2CH_2NR^5R^5$ or —$NR^6R^6$, where each $R^5$ is independently hydrogen or hydrocarbyl and each $R^6$ is independently hydrogen, hydrocarbyl, or an alkyleneamine group. Polyetheramines and their methods of preparation are described in greater detail in U.S. Pat. No. 6,458,172, columns 4 and 5. Various polyetheramides and polyethercarbamates may be prepared by reacting a polyether chain (derived from an alcohol and an alkylene oxide) with a reagent of appropriate functionality. Polyether alcohols include hydrocarbyl-terminated poly(oxyalkylene) monools, including the hydrocarbyl-terminated poly(oxypropylene) monools described in greater detail in U.S. Pat. No. 6,348,075; see in particular column 8. The hydrocarbyl group may be an alkyl or alkyl-substituted aromatic group of 8 to 20 carbon atoms, such as $C_{12-16}$ alkyl or nonylphenyl.

Viscosity Modifiers Containing Dispersant Functionality.

Polymeric viscosity index modifiers (VMs) are extremely well known in the art and most are commercially available. When dispersant functionality is incorporated onto the viscosity modifier, the resulting material is commonly referred to as a dispersant viscosity modifier. For example, a small amount of a nitrogen-containing monomer may be copolymerised with alkyl methacrylates, thereby imparting dispersancy properties into the product. Thus, such a product has the multiple function of viscosity modification and dispersancy, and sometimes also pour point depressancy. Vinyl pyridine, N-vinyl pyrrolidone and N,N'-dimethylaminoethyl methacrylate are examples of nitrogen-containing monomers which may be copolymerised with other monomers such as alkyl methacrylates to provide dispersant viscosity modifiers.

Dicarboxylic Acid of an Aromatic Compound

The present invention further comprises a 1,3-dicarboxylic acid or 1,4-dicarboxylic acid of an aromatic compound, or a reactive equivalent thereof, or mixtures thereof, which is reacted or complexed with the dispersant. The term "a reactive equivalent thereof" include acid halides, esters, amides, anhydrides, salts, partial salts, or mixtures thereof. The "aromatic component" is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the dispersant by salt formation or complexation, rather than formation of covalently bonded structures such as amides, which may also be formed but may play a less important role. Typically the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. Other ring substituents such as hydroxy or alkoxy (e.g., methoxy) groups may also be present in certain embodiments. In one embodiment the aromatic compound is terephthalic acid.

The Dimercaptothiadiazole

The present invention further comprises a dimercaptothiadiazole. Examples include 2,5-dimercapto-1,3-4-thiadiazole or a hydrocarbyl-substituted 2,5-dimercapto-1,3-4-thiadiazole, or an oligomer thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

The number of carbon atoms on the hydrocarbyl substituents in several embodiments ranges from 1 to 30, 2 to 20 or 3 to 16.

In one embodiment the hydrocarbyl-substituted mercaptothiadizoles (as well as the unsubstituted materials) are typically substantially soluble at 25° C. in non-polar media such as an oil of lubricating viscosity. Thus, the total number of carbon atoms in the hydrocarbyl-substituents, which tend to promote solubility, will generally be 8 or more, or 10 or more, or at least 12. If there are multiple hydrocarbyl substituents, preferably each substituent will contain 8 or fewer carbon atoms.

In one embodiment the hydrocarbyl-substituted mercaptothiadizoles (as well as the unsubstituted materials) are typically substantially insoluble at 25° C. in non-polar media such as an oil of lubricating viscosity. Thus, the total number of carbon atoms in the hydrocarbyl-substituents, which tend to promote solubility, will generally be fewer than 8, or 6, or 4. If there are multiple hydrocarbyl substituents, preferably each substituent will contain 4 or fewer carbon atoms.

By the term "substantially insoluble" it is meant that the dimercaptothiadiazole compound will typically dissolve to an extent of less than 0.1 weight percent, typically less than 0.01 or 0.005 weight percent in oil at room temperature (25° C.). A suitable hydrocarbon oil of lubricating viscosity in which the solubility may be evaluated is Chevron™ RLOP 100 N oil. The specified amount of the DMTD or substituted DMTD is mixed with the oil and the solubility may be evaluated by observing clarity versus the appearance of residual sediment after, e.g., 1 week of storage.

The mixture of dispersant, dicarboxylic acid of an aromatic compound and the mercaptothiadiazole is treated with either a borating agent or an inorganic phosphorus acid or anhydride, or both the borating agent and the phosphorus compound. The components may be combined and reacted in any order. In particular, the phosphorus acid or borating agent may be a pre-treatment process or a post-treatment process. Thus, for instance, phosphoric acid or boric acid may be reacted with a dispersant in one step, and thereafter the intermediate phosphorylated or borated dispersant may be reacted with the mercaptothiadiazole and the dicarboxylic acid of an aromatic compound. Alternatively, the dispersant, dicarboxylic acid of an aromatic compound and mercapthothiadiazole may be first reacted, and then the product treated with phosphoric an inorganic phosphorus acid or a borating agent. In yet another variation, a phosphorylated succinimide dispersant may be prepared by reacting a phosphorus acid with a hydrocarbyl-substituted succinic anhydride to prepare a mixed anhydride-acid precursor, and then reacting the precursor with a polyamine to form a phosphorus-containing dispersant. The phosphorus-containing dispersant may thereafter be reacted with the dicarboxylic acid of an aromatic compound and mercaptothiadiazole; and optionally with the borating agent.

Borating agents include various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_xB(OH)_y$ wherein x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally a hydrated particulate metal borate which are known in the art. Alkali metal borates include mixed alkali and alkaline metal borates. These metal borates are available commercially.

The phosphorus acid compound, or a reactive equivalent thereof may contain an oxygen atom and/or a sulfur atom as its constituent elements, and is typically a phosphorus acid or anhydride. This component includes the following examples: phosphorous acid, phosphoric acid, hypophosphorous acid, polyphosphoric acid, phosphorus trioxide, phosphorus tetroxide, phosphorous pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid or their anhydrides are preferred. A salt, such as an amine salt of a phosphorus acid compound may also be used. It is also possible to use a plurality of these phosphorus acid compounds together. The phosphorus acid compound is preferably phosphoric acid or phosphorous acid or their anhydride.

The phosphorus acid compound may also include phosphorus compounds with a phosphorus oxidation of +3 or +5, such as, phosphates, phosphonates, phosphinates, or phosphine oxides. A more detailed description for these suitable phosphorus acid compounds is found in U.S. Pat. No. 6,103,673, column 9, line 64 to column 11, line 8.

In one embodiment the phosphorus acid compound is an inorganic phosphorus compound.

The components are typically reacted by heating the borating agent and/or the phosphorus acid compound (together or sequentially) with the remaining components, that is, with the dispersant, dicarboxylic acid of an aromatic compound and the dimercaptothiadiazole, although other orders of reaction are possible, as described above. The heating will be at a sufficient time and temperature to assure solubility of resulting product, typically 80-200° C., or 90-180° C., or 120-170° C., or 150-170° C. The time of reaction is typically at least 0.5 hours, for instance, 1-24 hours, 2-12 hours, 4-10 hours, or 6-8 hours. The length of time required for the reaction is determined in part by the temperature of the reaction, as will be apparent to one skilled in the art. Progress of the reaction is generally evidenced by the evolution of $H_2S$ or water from the reaction mixture. Typically, the $H_2S$ is derived from one or more of the sulfur atoms in the dimercaptothiadiazole.

The reaction product may typically contain 0.5 to 2.5 weight percent sulfur derived from component (c), or 1 to 2 weight percent, or 1.25 to 1.5 weight percent sulfur. It may likewise contain 0.2 to 0.6 weight percent boron from component (d), or 0.3 to 1.1 percent phosphorus from component (e), or such amounts from both components (d) and (e).

The reaction may be conducted in a hydrophobic medium such as an oil of lubricating viscosity which may, if desired, be retained in the final product. The oil, however, should preferably be an oil which does not itself react or decompose under conditions of the reaction. Thus, oils containing reactive ester functionality are not generally preferable for use as the diluent. Oils of lubricating viscosity are described in greater detail below.

The relative amounts of the components which are reacted are, expressed as parts by weight prior to reaction are typically 100 parts of (a) the dispersant, per 0.0005 to 0.5 parts of (b) the dicarboxylic acid of an aromatic compound, 0.75 to 6 parts of (c) the dimercaptothiadiazole or substituted dimercaptothiadiazole, and 0 to 7.5 parts of (d) the borating agent and 0 to 7.5 parts of (e) the phosphorus acid compound. In one embodiment the relative amount of (b)+(c)+(d)+(e) is at least 1.5 parts. In a one embodiment the relative amounts are 100 parts of (a), 0.0005 to 0.1 parts of (b), 1.5 to 6 parts of (c), 0 to 4.5 parts of (d), and 0 to 4.5 parts of (e), provided that (c)+(d)+(e) is at least 1.5 parts. In another embodiment, the relative amounts are 100 parts (a) δ 0.0025 to 0.075 or 0.0025 to 0.050 parts (b): 1.5 to 5.0 parts (c): 3.7 to 4.4 parts (d): 0 to 4.4 parts (e). As otherwise expressed, the amount of the aromatic acid such as terephthalic acid in the reaction mixture may also be 5 to 5000 parts per million (ppm) by weight, or 5 to 1000 ppm, or 25 to 500 ppm. The amounts and ranges of the various components, in particular, (d) and (e), may be independently combined so that there may be, for instance, 3.7 to 4.4 parts of (d) whether or not any of (e) is present, and likewise there may be 1.5 to 4.4 parts (e) whether or not any of (d) is present The above-described reaction product is typically used in an oil of lubricating viscosity to provide a lubricant or an additive concentrate. Oils of lubricating viscosity may be derived from a variety of sources, and include natural and synthetic lubricating oils and mixtures thereof. The source of the oil or process for preparing the oil is generally not of particular importance unless that source or process provides some particular benefit, provided that the oil falls within one or more of the descriptions, below.

The natural oils useful in making the inventive lubricants and functional fluids include animal oils and vegetable oils (e.g., lard oil, castor oil) as well as mineral lubricating oils such as liquid petroleum oils and solvent-treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Useful natural base oils may be those designated by the American Petroleum Institute (API) as Group I, II, or III oils. Group I oils contain <90% saturates and/or >0.03% sulfur and have a viscosity index (VI) of ≧80. Group II oils contain ≧90% saturates, ≦0.03% sulfur, and have a VI≧80. Group III oils are similar to group II but have a VI≧120.

Upon occasion, highly refined or hydrocracked natural oils have been referred to as "synthetic" oils. More commonly, however, synthetic lubricating oils are understood to include hydrocarbon oils and halo-substituted hydrocarbon oils such as polymerised and interpolymerised olefins (e.g., polybutylenes, polypropylenes, propylene-isobutylene copolymers, chlorinated polybutylenes); poly(1-hexenes), poly(1-octenes), poly(1-decenes), poly(1-dodecene), copolymers of 1-decence and 1-dodecene; and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof and the like. Poly-alpha olefin oils are also referred to as API Group IV oils. (API Group V oils are "all others.")

In one embodiment, the oil of lubricating viscosity is a poly-alpha-olefin (PAO). Typically, the poly-alpha-olefins are derived from monomers having from 4 to 30, or from 4 to 20, or from 6 to 16 carbon atoms. Examples of useful PAOs include those derived from 1-decene. These PAOs may have a viscosity from 2 to 150.

Preferred base oils include poly-α-olefins such as oligomers of 1-decene or 1-dodecene, or copolymer thereof. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as preferred base oils are highly hydrocracked (or hydrotreated) and dewaxed oils. These petroleum oils are generally refined to give enhanced low temperature viscosity and antioxidation performance. Mixtures of synthetic oils with refined mineral oils may also be employed.

Another class of oils is known as traction oils, which are typically synthetic fluids containing a large fraction of highly branched or cycloaliphatic structures, i.e., cyclohexyl rings. Traction oils or traction fluids are described in detail, for example, in U.S. Pat. Nos. 3,411,369 and 4,704,490.

Other suitable oils may be oils derived from a Fischer-Tropsch process and hydrogenation.

When used as a lubricant, the amount of the above-described reaction product is typically 0.25 to 90, or from 0.5 to 90 percent by weight of the composition, the balance being the oil of lubricating viscosity and any other components or additives desired for the application at hand. This broad range encompasses both fully formulated lubricant and concentrates. In a fully formulated lubricant the amount of the reaction product is typically 0.5 to 20, 10, or 5 percent by weight, such as 1 to 4 or 2 to 3 percent by weight. When used as an additive concentrate, (designed to be added to a lubricant to prepare a fully formulated lubricant) the amount of the present reaction product may be 20 to 90 percent by weight or 40 to 80 percent by weight.

Lubricants of the present invention may be used for lubricating a variety of mechanical devices, including internal combustion engines (diesel or gasoline powered, two or four stroke cycle), transmission (including transmissions for automobiles, trucks, and other equipment such as manual transmissions, automatic transmissions, automated manual transmissions, continuously variable transmissions, dual clutch transmissions, farm tractor transmissions, transaxle, heavy duty power-shift transmissions, and wet brakes) as well as gears such as automotive gears and farm tractor gears.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Terephthalic Acid+DMTD+Boric Acid

A reaction vessel with a 4-neck round bottom flask fitted with a mechanical stirrer, subsurface nitrogen sparge, thermowell, and Dean-Stark trap fitted with a condenser vented to caustic and bleach traps is charged with 2137 g succinimide dispersant (reaction product of polyisobutylene substituted succinic anhydride with polyethylene amine bottoms, containing diluent oil) and 1422 g additional diluent oil and is heated, with stirring, to 83° C. and 114 g of boric acid is added before heating to 152° C. over 2.5 hours and water is removed. To the mixture is added 1.16 g of terephthalic acid and the mixture is heated to 160° C. At 160° C. 25.2 g of 2,5-dimercapto-1,3,4-thiadiazole (DMTD) in portions such that each subsequent addition is effected after the previous portion has dissolved. The mixture is stirred until evolution of $H_2S$ ceases before filtration to produce a final product.

Example 2

Terephthalic Acid+DMTD+Boric Acid+Phosphorous Acid

Example 1 is substantially repeated except that 77.8 g phosphorous acid is added along with the boric acid.

Example 3

Mannich Dispersant

Example 1 is substantially repeated except that the dispersant is a Mannich dispersant.

Example 4

$H_3PO_4$

Example 4 is substantially the same as Example 2, except 85% $H_3PO_4$ is used instead of phosphorous acid.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

What is claimed is:

1. A composition comprising the product prepared by heating together:

(a) a dispersant; and (b) a 1,3-dicarboxylic acid or 1,4-dicarboxylic acid of an aromatic compound, or a reactive equivalent thereof, wherein the dicarboxylic acid (b) comprises terephthalic acid; and at least one of:

(c) 2,5-dimercapto-1,3,4-thiadiazole or a hydrocarbyl-substituted 2,5-di-mercapto-1,3,4-thiadiazole, or an oligomer thereof;

(d) a borating agent; and (e) a phosphorus acid compound, or a reactive equivalent thereof;

said heating being sufficient to provide a reaction product of (a), (b), and (c), (d), or (e) which is soluble in an oil of lubricating viscosity.

2. The composition of claim 1 wherein the dispersant is a succinimide dispersant.

3. The composition of claim 1 wherein the dispersant is a Mannich dispersant.

4. The composition of claim 1 wherein the dispersant an ester-containing dispersant.

5. The composition of claim 1 wherein the dispersant is a viscosity modifier containing dispersant functionality.

6. The composition of claim 1 wherein component (c) is 2,5-dimercapto-1,3,4-thiadizole.

7. The composition of claim 1 wherein component (c) is a hydrocarbyl-substituted 2,5-dimercapto-1,3,4-thiadiazole wherein the hydrocarbyl group or groups contain a total of less than about 8 carbon atoms.

8. The composition of claim 1 wherein the borating agent is an inorganic borating agent.

9. The composition of claim 1 wherein the borating agent is boric acid.

10. The composition of claim 1 wherein the phosphorus acid compound or a reactive equivalent thereof is phosphoric acid, phosphorous acid or an anhydride thereof.

11. The composition of claim 1 wherein the components have been heated together at about 80 to about 200° C. for at least about 0.5 hours.

12. The composition of claim 1 wherein the components have reacted as evidenced by the evolution of $H_2S$ or $H_2O$.

13. The composition of claim 1 wherein the components are heated together in a hydrophobic medium.

14. The composition of claim 13 wherein the hydrophobic medium is an oil of lubricating viscosity.

15. The composition of claim 14 wherein the oil of lubricating viscosity is retained in the composition of matter.

16. The composition of claim 1 wherein the relative amounts, by weight, of components (a), (b), (c), (d), and (e) prior to heating, are about 100 of (a): (0.0005 to 0.5 of (b)): (0.75 to 6 of (c)): (0 to 7.5 of (d)): (0 to 7.5 of (e)).

17. The composition of claim 1 wherein the relative amounts, by weight, of components (a), (b), (c), (d), and (e) prior to heating, are about 100 of (a): (0.0005 to 0.5 of (b)):

(0.75 to 6 of (c)): (0 to 7.5 of (d)): (0 to 7.5 of (e)), provided that the relative amount of (b)+(c)+(d)+(e) combined is at least about 1.5.

18. A composition comprising an oil of lubricating viscosity and the reaction product of claim 1.

19. The composition of claim 18 wherein the amount of the reaction product is about 0.25 to about 90 percent by weight of the composition.

20. The composition of claim 19 wherein the amount of the composition within the oil-containing composition is about 0.5 to about 5 percent by weight.

21. The composition of claim 19 wherein the amount of the composition within the oil-containing composition is about 20 to about 90 percent by weight.

22. A method for lubricating a mechanical device, comprising supplying thereto the composition of claim 18.

23. The method of claim 22 wherein the mechanical device is an internal combustion engine.

24. The method of claim 22 wherein the mechanical device is an automatic transmission.

25. The method of claim 22, wherein the mechanical device comprises gears.

* * * * *